US005297796A

United States Patent [19]

Peterson

[11] Patent Number: 5,297,796

[45] Date of Patent: Mar. 29, 1994

[54] GOLF SWING MONITORING SYSTEM

[76] Inventor: Jon R. Peterson, 1250 Long Beach Ave. # 204, Los Angeles, Calif. 90021

[21] Appl. No.: 863,110

[22] Filed: Apr. 3, 1992

[51] Int. Cl.[5] ..... A63B 69/36

[52] U.S. Cl. ..... 273/183.1; 434/252; 273/DIG. 28

[58] Field of Search ..... 273/35 R, 35 A, 183.1, 273/187.6, DIG. 28; 435/252; 434/247

[56] References Cited

U.S. PATENT DOCUMENTS

| | | | |
|---|---|---|---|
| 2,747,406 | 5/1956 | Cutler | 273/35 R X |
| 3,110,495 | 11/1963 | Carter | 273/35 A |
| 3,408,750 | 11/1968 | McCollough et al. | 435/252 |
| 3,820,133 | 6/1974 | Adorney et al. | 273/186.1 |
| 3,918,073 | 11/1975 | Henderson et al. | 354/120 |
| 4,150,825 | 4/1979 | Wilson | 273/185 B |
| 4,160,942 | 7/1979 | Lynch et al. | 273/185 A X |
| 4,163,941 | 8/1979 | Linn | 273/186.1 X |
| 4,451,043 | 5/1984 | Ogawa et al. | 273/186.1 |
| 4,542,906 | 9/1985 | Takase et al. | 273/185 R |
| 4,572,512 | 2/1986 | Tegart | 273/176 A |
| 4,858,934 | 8/1989 | Ladick et al. | 273/186.3 |
| 4,934,705 | 6/1990 | Shirley | 273/176 R |
| 4,958,836 | 9/1990 | Onozuka et al. | 273/184 R |

*Primary Examiner*—George J. Marlo
*Attorney, Agent, or Firm*—Harlan P. Huebner

[57] ABSTRACT

A visual monitoring system for a golfer to simultaneously watch his golf swing while the swing is being made. The system includes one or more video cameras and a video monitoring screen mounted below a transparent surface where the swing is being made with a golf club for viewing the swing without distorting the head of the golfer during the golf swing.

5 Claims, 2 Drawing Sheets

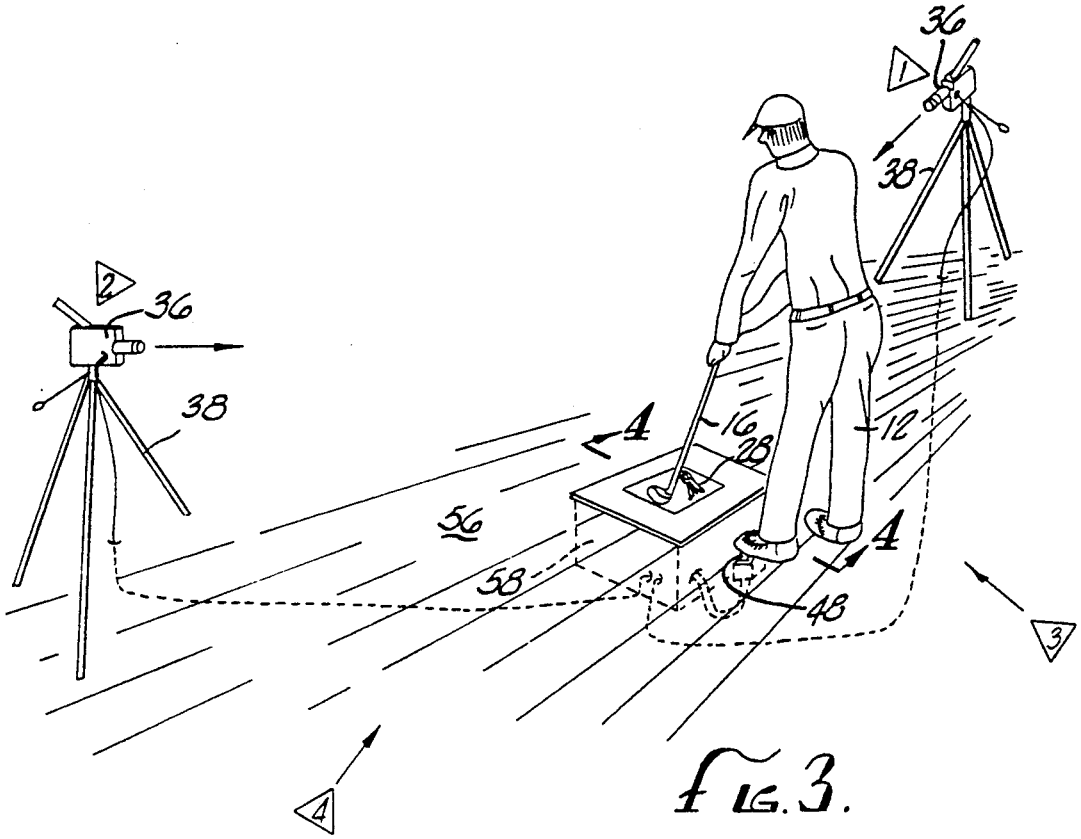
FIG. 3.
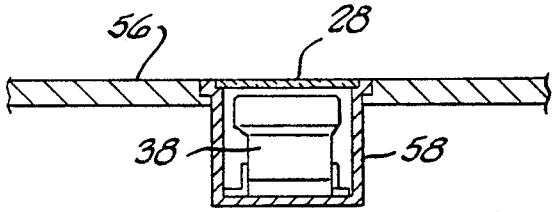
FIG. 4.
FIG. 5.
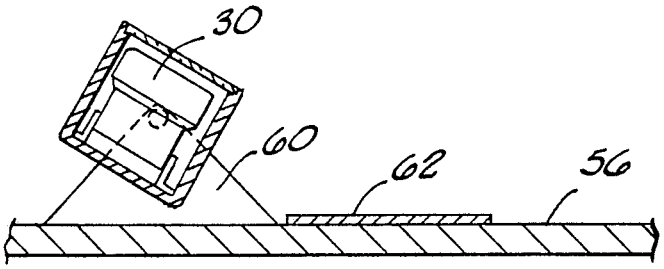

GOLF SWING MONITORING SYSTEM

BACKGROUND OF THE INVENTION

1. Field of the Invention

This invention relates to a golf swing monitoring system and particularly a system that lets the golfer see his swing as he is making it.

2. Description of the Prior Art

There are many very complicated and sophisticated monitoring systems of golfers swings presently on the market. However, all the devices or systems presently available will take tapes of the swing through video cameras and can only be viewed after the swing is made. The tapes are replayed because they are a permanent record.

Such devices have draw backs due to the fact the swing is finished and the golfer cannot stop to view his actions during execution of the same. There is a lag time between the actual swing and the play back of the swing.

SUMMARY OF THE INVENTION

It is a purpose of the present invention to provide a television or video monitoring system and structure to allow a golfer during his golf swing to view his swing and critique or modify the swing as it is being made.

Another object of the present monitor is to provide a television monitor mounted with a viewing capability so that the golfer may look at this swing without diverting his head during the swing.

A further object of the present invention is to provide any number of television or video cameras that may be adjustably placed around the golfer to capture what part of the swing is desired to be seen.

A still further object of the present invention is to provide a portable or stationery system for simultaneously viewing a golf swing by the golfer as the swing is being made.

Another object of the present invention is to recess a television monitor with a clear window of material over the top representing the surface and spot where a golf swing may be made at an imaginary golf ball.

A yet further object of the present invention is to provide a foot switch for the golfer to actuate the system and turn on one of a plurality of television cameras that are arranged around the golfer so that various parts of the swing may be viewed.

Another object of the present invention is to provide an adjustable monitor in front of a golfer above the surface the swing is made on.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages maybe more clearly understood from the following detailed description and by reference to the drawings in which:

FIG. 3 is a modified form of the present invention where the installation is fixed as below a floor;

FIG. 4 is a cross sectional view taken on 4—4 of FIG. 3; and

FIG. 5 is a cross sectional view of a modified position for the television monitor.

DETAILED DESCRIPTION OF THE PREFERRED EMBODIMENT

Figure 1:
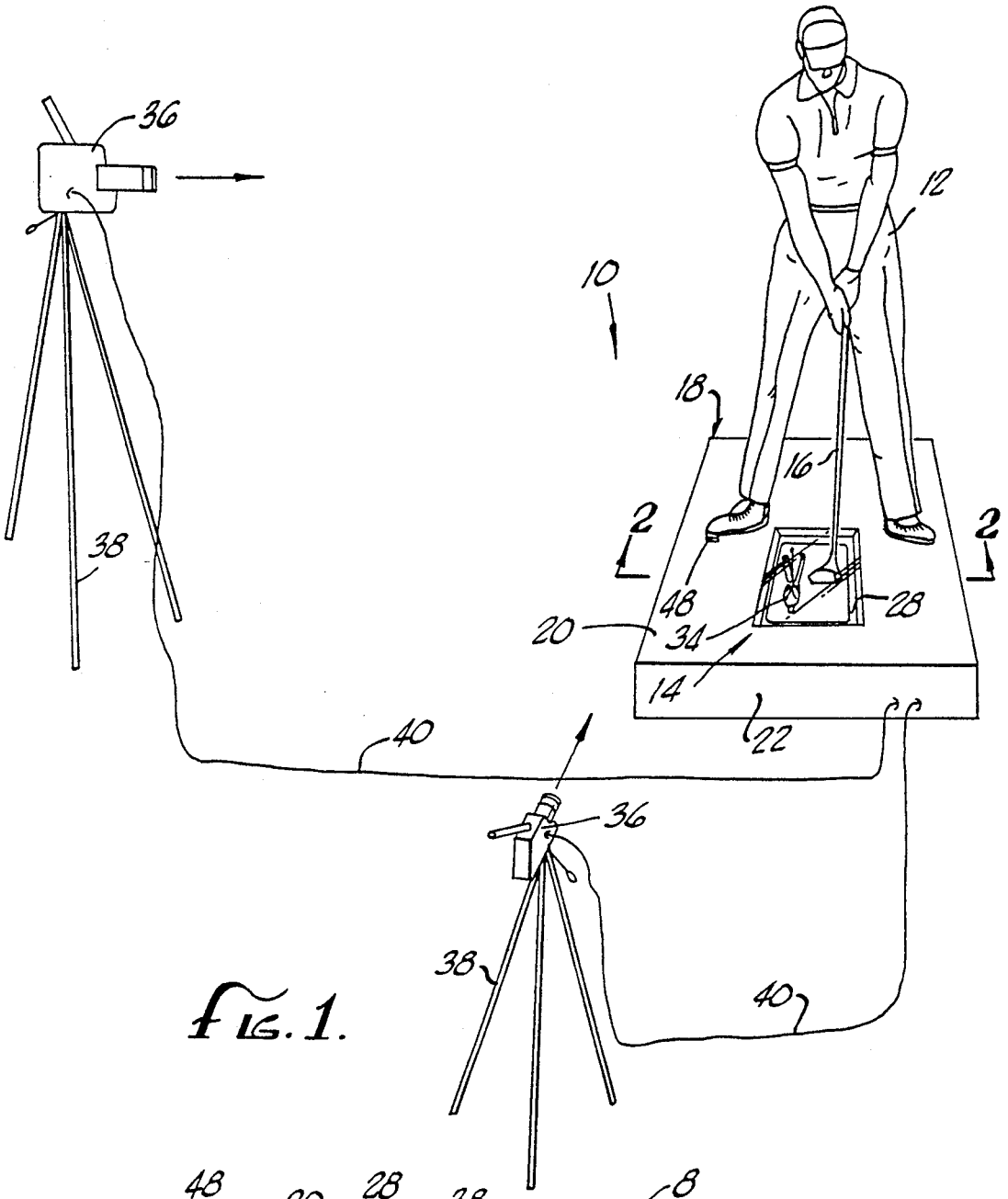
FIG. 1 is an environmental view of the present invention with a golfer in position on a portable structure to make a swing at an imaginary golf ball.
Figure 2:
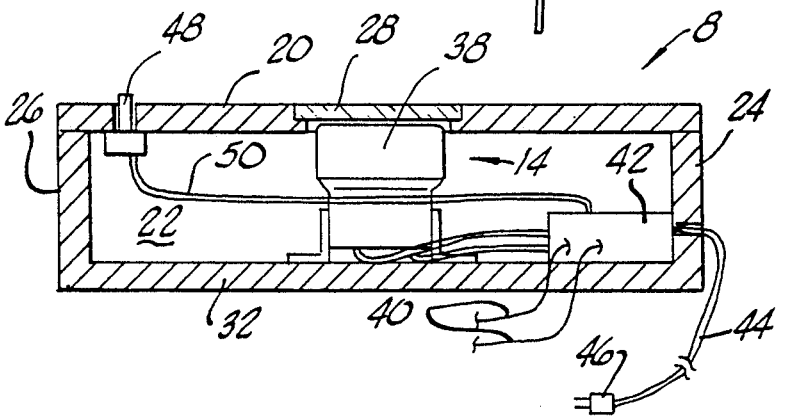
FIG. 2 is cross sectional view taken on line 2—2 of FIG. 1 illustrating a television monitor and control means for television cameras used for simultaneously transmitting the golfer's swing image to the monitor.

In FIG. 1 the golf swing monitoring system generally designated 10 is illustrated. The system 10 is created so that a golfer 12 standing adjacent a monitor viewing means 14 may take practice golf swings with a golf club 16 and be able to view the swing as it is being made. In this way defects can be seen instantly and correction made with the next swing.

With the system 10 the golfer 12 may arrange for equipment to photograph the golfer 12 from various angles during the swing and the golfer may control which angle is to be seen through the monitor viewing means 14.

In the embodiment of FIG. 1 the system 10 can be considered as portable in nature. This type of unit might be owned by a golfer and setup in a garage, basement or other areas, yet is portable enough to be disassembled and stored when not in use.

There is a platform or base designated 18 upon which the golfer 12 stands when making the swings. In the embodiment of FIG. 1 the platform 18 includes a generally flat base surface 20 to stand on. The base surface 20 is elevated by means of vertical end walls 22 and generally parallel side walls 24 and 26. The height of the base surface 20 above the ground will depend on the depth of the monitor viewing means 14.

As you can see in FIG. 1 the platform is fitted with a window 28 which is recessed in the platform and serves as the area where an imaginary golf ball would be placed. Due to the fact that impact is possible a relatively thick and strong shatter-proof clear plastic is best fitted to form the window 28. The size of the window 8 will usually be governed by the exterior dimensions of a conventional television or video monitor 38. The window 28 overlays the monitor 38. The monitor 38 may be fixedly mounted within the platform 18 on a bottom surface 32 or could be secure to the base surface 20 if there is no bottom surface.

In order to cause an image 34 to appear on the monitor 30 a plurality of conventional portable television or video cameras 36 may be mounted on tripods 38 and by wires 40 convey the image to control box 42. The camera's being on the tripods 38 are movable and positioned preferable in front and at the side of the golfer 12. These positions are best to determine the correctness of a golf swing. However, should a golfer desire to see himself from the back during a swing a camera 36 may be located in back of the golfer 12. Generally speaking, only two cameras 36 are necessary.

Conventional AC power for the monitor 38 and cameras 36 can be brought in through wire 44 and plug 46. Also, a battery pack could be used with equal effect.

In order for the golfer 12 to control which camera angle he wishes to view while making his golf swing there is provided a switching means or a foot switch 48 that may be depressed to see the view from one or the other of the cameras. The switch 48 has lead wires 50 that run to the control box 42 to effect the turning off or on of one or the other of the cameras 36.

While the preference is to employ two cameras 36, the system would operate by using one camera 36 and as the golfer 12 desired it could be moved to another position.

As can be seen with the positioning of the monitor 38 directly under the spot when an imaginary golf ball would rest, the golfer 12 does not have to look up or readjust his normal head position during the swing.

In FIGS. 3 through 5 a modified arrangement of the system 10 is illustrated. This is referred to as permanent installation particularly suited for pro shops and golf practice ranges.

The monitor viewing means 14 is mounted in a building floor 56 or it could also be mounted in the ground if used at an outdoor golf practice range.

Again, there is a window 28 that may be recessed in the flooring 56 or build into a self contained box 58. Also, there may be one or more video cameras 36 on tripods 38 to pickup the golf swing. If more than one, then a foot switch 48 is advisable.

In FIG. 5 another modification is illustrated in that the monitor 30 is mounted in an adjustable frame 60 and that in turn mounted on the surface 56 or platform 18. If this structure is used, the window 28 would be replaced by material such as artificial turf 62 upon which the swing is made.

As can be seen in FIG. 5 the monitor 30 may be tilted to achieve a proper angle to the golfer's eyes so that a swing will not distort the golfer's head when trying to look at the monitor at the same time as the swing is being made with the club 16.

Finally, while not illustrated, the system 10 could be used with an artificial turf section laid on the base surface 20 or floor 56 adjacent the window 28. In that way the golfer 12 could take his practice swings on the turf and see himself in the monitor 30 at the same time. Also with the turf the golfer could hit a practice ball instead of an imaginary ball. This particular arrangement may have a slight disadvantage in that it would require the golfer to elevate his head to see the monitor. This could distort his swing as the elevation could cause him to take his eyes off of the imaginary golf ball by the increased elevation of the head.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

I claim:

1. A golf swing monitoring system for a golfer to view simultaneously with the swing being made by the golfer holding a golf club to assist the golfer in determining the correctness or faults thereof of the golf swing, said system comprising:

a base surface upon which a golfer stands to address an imaginary golf ball and said surface includes a window of transparent material upon which the golfer takes practice swings;

a video monitoring means mounted beneath said window, said monitoring means viewable by said golfer during the addressing of and swinging at said imaginary golf ball on said window without moving the head or shifting the eyes from the line of said imaginary golf ball while viewing the swing in said monitoring means;

at least one video camera mounted to focus on said golfer and connected to said video monitoring means to convey the image of said golfer to said monitoring means; and foot control switch means on said base surface to activate said camera and said video monitoring means for effecting the simultaneous viewing of said swing during the execution of said swing, said switch is activated by a foot of said golfer for individual control.

2. A golf swing monitoring system as defined in claim 1 wherein:

said video camera includes a mounting stand for portability and said stand and camera may be placed at any angle around said golfer to provide the golfer with whatever angle the golfer desires to see during the golf swing.

3. A golf swing monitoring system as defined in claim 2 wherein:

there are at least two video cameras and said foot control switch means is adapted to switch from one camera to the other to view different angles of the golf swing while it is in progress.

4. A golf swing monitor system as defined in claim 1 wherein:

said base surface is a floor of a structure, and said surface includes a window of transparent non-breakable material with said video monitoring means mounted beneath said window and the golf swing is directed to said imaginary golf ball located on said window.

5. A golf swing monitor system as defined in claim 1 wherein:

said base surface is part of a raised portable platform and said surface includes a window of transparent non-breakable material with said video monitoring means mounted beneath said window within said portable platform and the golf swing is directed to said imaginary golf ball located on said window.

* * * * *